US005829327A

United States Patent [19]

Stanton

[11] Patent Number: 5,829,327

[45] Date of Patent: Nov. 3, 1998

[54] OPEN-END RATCHET WRENCH

[76] Inventor: John L. Stanton, 1550 Hazelwood Dr., Clarksville, Tenn. 37043

[21] Appl. No.: 728,627

[22] Filed: Oct. 10, 1996

[51] Int. Cl.[6] ..... B25B 13/28

[52] U.S. Cl. ..... 81/111; 81/94

[58] Field of Search ..... 81/92, 94, 100, 81/111, 179

[56] References Cited

U.S. PATENT DOCUMENTS

| | | | |
|---|---|---|---|
| 1,406,467 | 2/1922 | Matthey | 81/111 X |
| 1,489,458 | 4/1924 | Petersen | 81/111 X |
| 2,426,191 | 8/1947 | Feiring | 81/111 |
| 2,712,259 | 7/1955 | Cowell . | |
| 2,795,160 | 6/1957 | Blasdell | 81/179 |
| 3,921,474 | 11/1975 | Dyck et al. . | |
| 3,927,582 | 12/1975 | Hertelendy et al. . | |
| 4,204,440 | 5/1980 | Del Prete et al. . | |
| 4,488,459 | 12/1984 | Bailey et al. . | |
| 4,574,665 | 3/1986 | Blachly . | |
| 4,644,830 | 2/1987 | Bailey et al. . | |
| 4,718,315 | 1/1988 | Nitschmann . | |
| 4,926,720 | 5/1990 | Srzanna . | |
| 5,456,143 | 10/1995 | Stanton . | |

FOREIGN PATENT DOCUMENTS

| | | |
|---|---|---|
| 568058 | 12/1923 | France . |

*Primary Examiner*—James G. Smith
*Attorney, Agent, or Firm*—Fish & Richardson P.C.

[57] ABSTRACT

A wrench includes a pair of jaws mounted to a handle. A first jaw is mounted for selective actuation by an actuator between a stationary position with respect to a second jaw so that the jaws engage and rotate the workpiece when the wrench handle is rotated, and a movable position with respect to the second jaw so that the jaws disengage and slide over the workpiece (e.g., in a ratchet-like manner) and allow the workpiece to remain stationary when the handle is rotated. The wrench operates in the selected mode of operation (i.e., driving or ratcheting) when the handle is rotated in either direction. Another wrench (which is not bi-directional) features a pair of plates pivotally mounted within cavities in a pair of spaced jaws on the wrench handle. Each plate includes a grasping surface for engaging a face of the workpiece and a curved peripheral surface which slidingly engages a curved bearing surface in the cavity so that the plate can pivot within the cavity. A spring biases the plates toward each other so that the plates engage the workpiece between the grasping surfaces and rotate the workpiece when the handle is rotated in a first direction; the biasing is overcome when the handle is rotated in a second, opposite direction to cause the plates to pivot within the cavities and spread away from the workpiece so that the grasping surfaces slide over the faces of the workpiece, allowing the workpiece to remain stationary.

19 Claims, 7 Drawing Sheets

OPEN-END RATCHET WRENCH

BACKGROUND OF THE INVENTION

This invention relates to ratchet wrenches, and more particularly to open-end ratchet wrenches that can be placed on a workpiece from the side.

There are many occasions when it is desirable to apply torque to a workpiece (such as a nut, bolt, or in-line hydraulic fitting) in order to, for example, rotate the workpiece with respect to a threaded member which the workpiece engages. Two well known tools for rotating workpieces are ratchet wrenches and open-end crescent wrenches. Ratchet wrenches are typically close-ended devices that completely encircle the workpiece and are thus installed on the workpiece from the top (or bottom, depending upon the orientation of the workpiece). In contrast, open-end wrenches can be installed from the side of the workpiece.

Open-end wrenches are particularly useful in small spaces where there may only be sufficient room to install the wrench from the side. Moreover, in confined spaces, there is often insufficient space to accommodate the ratchet mechanism of typical close-ended ratchet wrenches. In addition, open-end wrenches are a must for tightening/loosening in-line fittings of hydraulic or fuel lines, which can only receive a wrench from the side.

Typical open-end crescent wrenches lack a ratchet mechanism. As a result, during a tightening or loosening operation, the wrench is removed from the workpiece after it has rotated the workpiece a relatively small amount (such as 30 degrees), and then replaced thereon at a different angle for continued rotation. This procedure is repeated (often many times) until the workpiece is completely tightened or loosened.

Open-end ratchet wrenches that resemble typical crescent wrenches have been developed for confined and in-line fitting applications. Some open-end ratchet wrenches employ numerous spring-loaded rollers, cams, or pawls for engaging the workpiece; others use an insert shaped to fit over the workpiece and engage an internal ratchet mechanism. Some of these wrenches encircle the workpiece to such an extent that, even though the wrenches have open ends, they must actually be installed vertically from above or below the workpiece.

SUMMARY OF THE INVENTION

One general aspect of this invention features a wrench in which a first jaw is mounted for selective actuation by an actuator between a stationary position with respect to a second jaw so that the jaws engage and rotate the workpiece when the wrench handle is rotated, and a movable position with respect to the second jaw so that the jaws disengage and slide over the workpiece and allow the workpiece to remain stationary when the handle is rotated.

Preferred embodiments may include one of more of the following features.

The first jaw is mounted so that, when in the stationary position, the jaws grip and rotate the workpiece when the handle is rotated in either of two directions with respect to the workpiece. Conversely, when the first jaw is in the movable position, the jaws slide over the workpiece when the handle is rotated either direction. A spring coupled between the handle and the first jaw biases the first jaw to the stationary position.

A plate attached to the first jaw is mounted to the handle by engagement of a plurality of pins on the handle with a corresponding plurality of slots in the plate. The actuator can move the plate to position the pins in selected portions of the slots, thereby moving the first jaw between the stationary and movable positions. The slots are configured so that the pin-slot engagement resists pivotal movement of the plate when the pins are positioned at ends of the slots. The pin-slot engagement allows the plate to pivot when the actuator positions the pins in regions of the slots that are spaced from the ends.

The biasing spring is coupled between the handle and the plate to bias the plate so that the pins are positioned at the ends of the slots, thereby urging the first jaw into the stationary position. The actuator is coupled to move the plate against the spring bias to position the pins in the spaced regions of the slots, thereby moving the first jaw to the movable position.

Preferably, the slots are disposed between the actuator and the first jaw. In one embodiment, the actuator is rigidly mounted to the plate. In another embodiment, a pivotal joint connects the actuator to the plate.

The spaced regions of the slots are arranged around a center of rotation located in a distal region of the first jaw. The first jaw rotates about the center of rotation and disengages a proximal region of the first jaw from the workpiece when the actuator positions the pins in the spaced regions. A segment of a first one of the slots is arranged around a center of rotation located at a second end of a second one of the slots, which is disposed proximally of the first slot. When the actuator positions a second one of the pins at the second end and the handle is rotated, the first jaw pivots about the second pin and the first pin travels in the segment. This allows the jaws to slide over the workpiece in a ratcheting manner. In some embodiments, a third slot, similar in configuration to the first slot, is also provided; in others, the third slot is omitted.

Preferably, the jaw is rigidly mounted to the handle. Each jaw includes at least one notch that defines a plurality of surfaces, each of which is arranged to engage a face of the workpiece. Reinforcing members are secured to both jaws.

Due to the locking and unlocking action, the wrench is completely bidirectional. That is, unlike some ratchet wrenches, which can drive a workpiece in one direction only and must be turned over to rotate the workpiece in the opposite direction, when my wrench is locked with the first jaw in the stationary position, it can be used to both tighten the workpiece (i.e., rotate the workpiece in a clockwise direction) and loosen the workpiece (by rotating it in a counterclockwise direction). In addition, when the wrench is unlocked with the first jaw in the movable position, the jaws will ratchet over the workpiece when the handle is rotated in either direction. Indeed, the jaw configuration enables the handle to be ratcheted by only 30 degrees (that is, one-twelfth of a turn) when the first jaw is unlocked in order to re-engage the workpiece; the wrench thus is in position to drive the workpiece when the user again locks the first jaw. As a result, the wrench can tighten or loosen the workpiece quickly and easily, while requiring no clearance from behind the workpiece.

The wrench is rugged and has few moving parts (e.g., the plate and the spring). Thus, the wrench is much easier to manufacture (and repair) than wrenches which employ many individual pawls or rollers in a ratcheting mechanism. The jaws engage the workpiece over a relatively large surface area, thereby maximizing torque transmission and minimizing contact stresses imposed on the wrench and the workpiece. This reduces the risk of damage to the wrench and the workpiece. The spacing between the jaws and their configuration permit the jaws to operate on the workpiece while engaging only four workpiece faces and encircling the workpiece through an arc of only 240 degrees. As a result, the wrench can easily be inserted onto and removed from the work piece from the side for ease of use in cramped spaces.

A second general aspect of the invention features a wrench that includes a pair of plates pivotally mounted within cavities in a pair of spaced jaws on the wrench handle. Each plate includes a grasping surface for engaging a face of the workpiece and a curved peripheral surface which slidingly engages a curved bearing surface in the cavity so that the plate can pivot within the cavity. A spring biases the plates toward each other so that the plates engage the workpiece between the grasping surfaces and rotate the workpiece when the handle is rotated in a first direction; the biasing is overcome when the handle is rotated in a second, opposite direction to cause the plates to pivot within the cavities and spread away from the workpiece so that the grasping surfaces slide over the faces of the workpiece, allowing the workpiece to remain stationary.

Preferred embodiments may include one or more of the following features.

The plates and the spring are arranged so that when the wrench is turned over with respect to the workpiece the wrench rotates the workpiece when the handle is rotated in the second direction. Thus, unlike the first aspect of the invention described above, this second aspect is not bidirectional. But, like the previously-described aspect, this wrench is rugged, simple to make, and easy to repair.

The curved peripheral surface of each plate and the curved bearing surface of the corresponding cavity have a common center of rotation. The jaws include bearing regions on which the bearing surfaces are disposed. In one embodiment, the bearing portions are spaced from each other by portions of the cavities. In another embodiment, the bearing portions are contiguous with each other.

The jaws further include stops positioned to limit the range of motion of the plates. In one embodiment, at least one of the stops is spaced from the bearing portions by portions of the cavities. In an alternative configuration, the bearing portions and the stops are contiguous with each other, and the cavities are spaced from each other thereby.

The spring preferably includes a portion that engages the handle and a pair of ends each of which engages one of the plates. Alternatively, spring includes a pair of springs each of which has an end that engages the handle and an end that engages one of the plates.

Other features and advantages will become apparent from the following detailed description, and from the claims.

DESCRIPTION OF PREFERRED EMBODIMENTS

Figure 2:
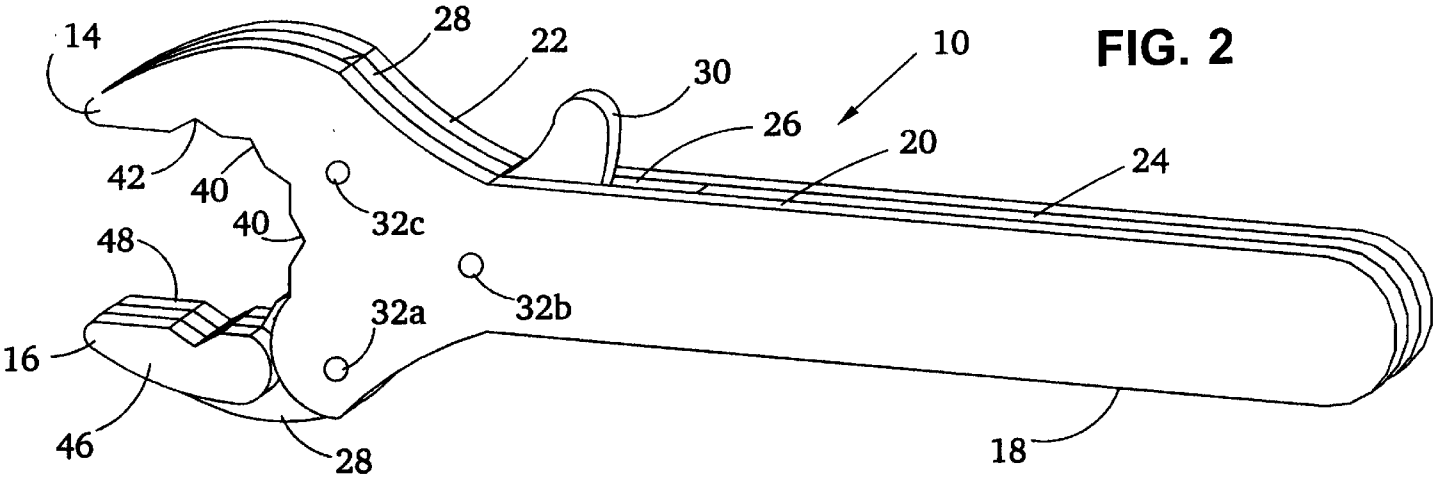
FIGS. 1–3 are a top plan view, a perspective view, and a side view, respectively, of an open-end ratchet wrench that is selectively locked to drive (e.g., rotate) a workpiece, and unlocked to ratchet with respect to the workpiece.
Figure 1:
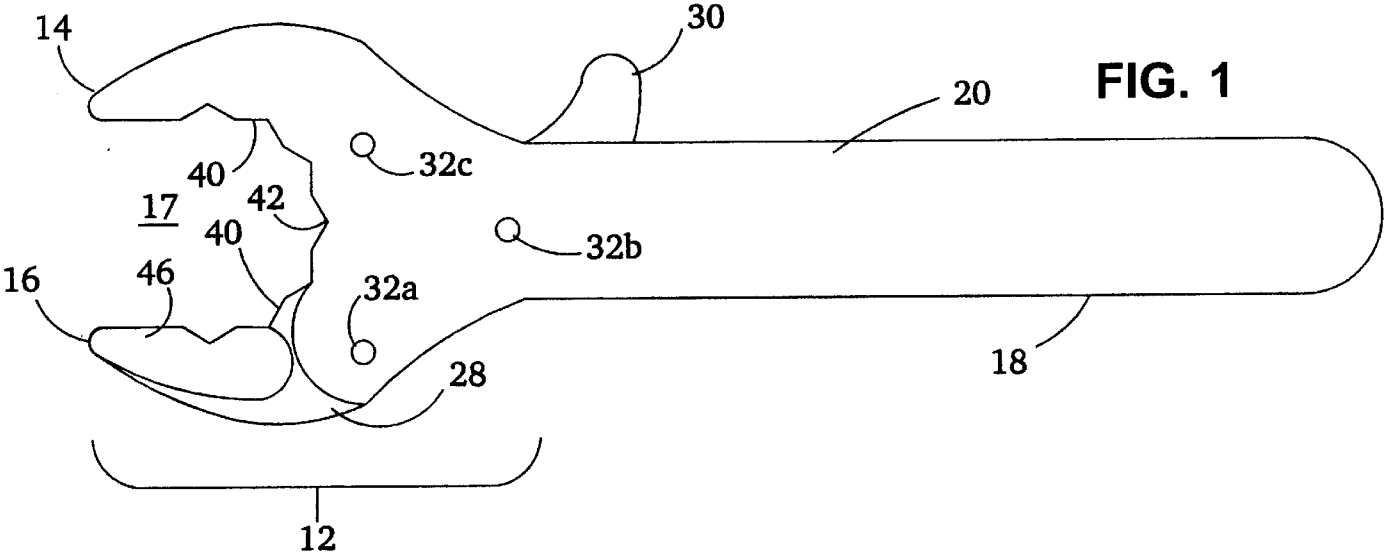

Referring to FIGS. 1–4, open end ratchet wrench 10 includes a head 12 having a pair of arcuate jaws 14, 16 mounted at the distal end of an elongated handle 18. Jaw 14 is a stationary, distal extension of handle 18. Jaw 16 is selectively actuatable between a locked position in which jaw 16 is stationary with respect to jaw 14, and an unlocked position in which jaw 16 is pivotable with respect to jaw 14, as described below. Jaws 14, 16 are spaced from each other by any suitable amount to partially encircle a central opening 17 that receives a workpiece (such as the head of a bolt, a nut, or an in-line fitting) by no more than 240 degrees. Accordingly, sufficient spacing is provided between the distal ends of jaws 14, 16 to allow wrench 10 to be inserted onto the workpiece from the side rather than from above (or below) the workpiece.

Jaw 14 and handle 18 are defined by a pair of face plates 20, 22. As shown in FIG. 2, face plates 20, 22 extend to the distal end of jaw 14 but terminate near the proximal end of jaw 16. Face plates 20, 22 are welded to a central plate 24 which terminates proximally of head 12 to define an opening 26 between plates 20, 22 in head 12. Opening 26 receives a movable plate 28, which is slightly thinner than central plate 24 so as to be freely movable within opening 26 when jaw 16 is unlocked. The distal end of movable plate 28 protrudes from plates 20, 22 and forms pivotable jaw 16. A user-actuatable lever 30 at the proximal end of movable plate 28 extends from opening 26 proximally of head 12.

Movable plate 28 is mounted within opening 26 by the engagement of pins 32*a*, 32*b*, 32*c* (which are secured to plates 20, 22) in corresponding slots 34*a*, 34*b*, 34*c* in plate 28. Slots 34*a*, 34*c* are somewhat "L-shaped," while slot 34*b* is relatively straight for purposes to be described. A leaf spring 36 extends from a proximal end secured within a groove 38 in central plate 24 to a distal end that engages an exterior surface of movable plate 28 to bias plate 28 to the position shown in FIG. 3.

Figure 3:
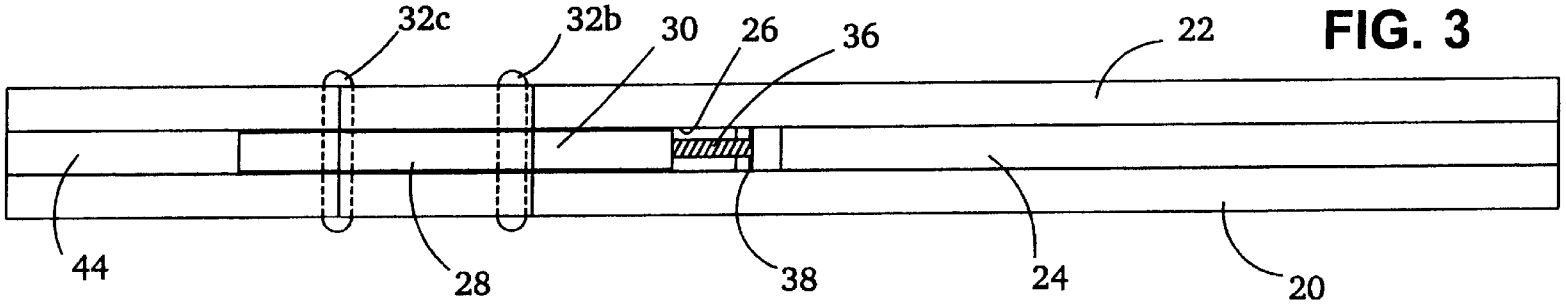
Figure 4:
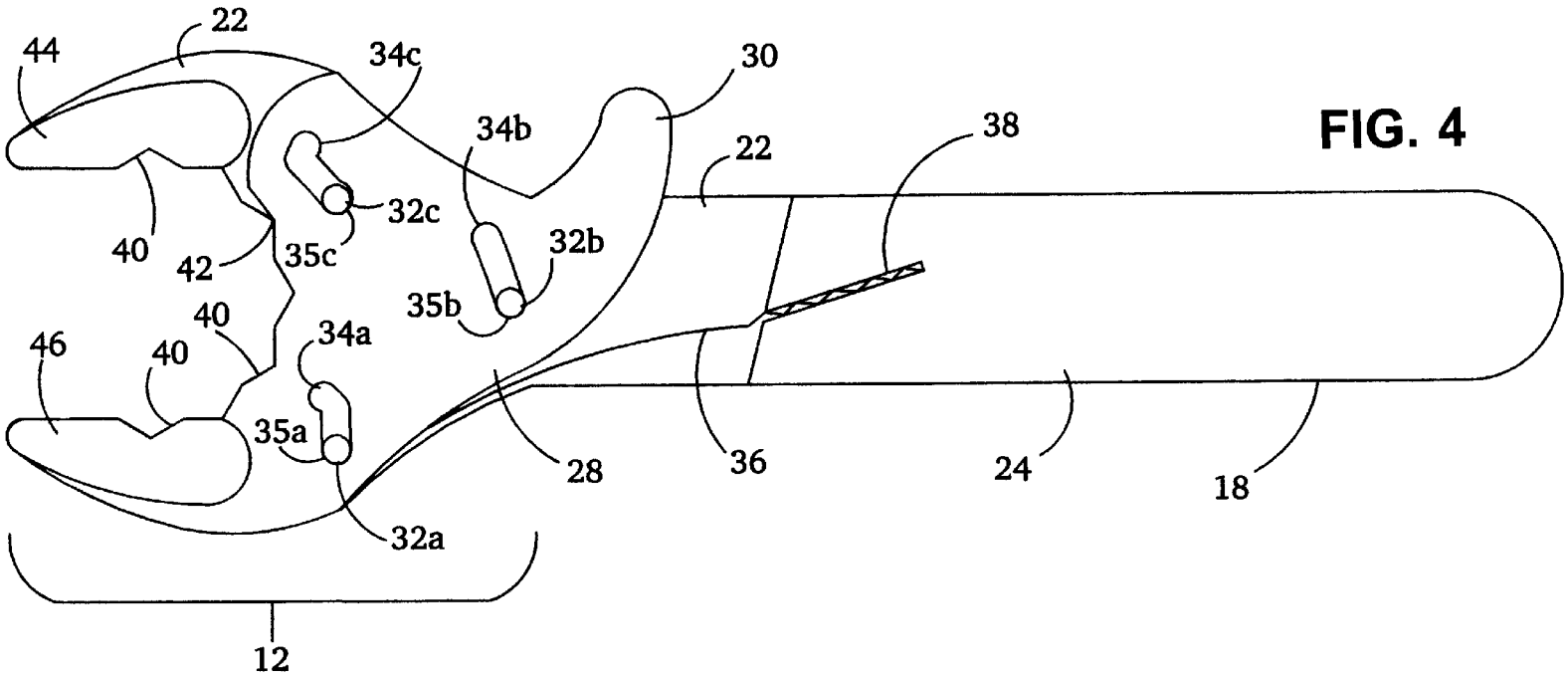
FIG. 4 shows the wrench of FIG. 1 with the front face plate removed to illustrate the locking and unlocking mechanism.

As discussed below, with movable plate 28 in the FIG. 3 position, pins 32*a*–32*c* engage ends 35*a*–35*c* of slots 34*a*–34*c*, and jaw 16 is locked in a stationary, gripping position so that wrench 10 can turn the workpiece in either direction (e.g., clockwise to tighten the workpiece or counterclockwise to loosen the workpiece) without ratcheting or slipping over the workpiece surfaces. The user unlocks jaw 16 by depressing lever 30, which causes movable plate 28 to pivot about a point located near the distal tip of jaw 16 until pins 32*a*, 32*c* are positioned in the corner of L-shaped slots 34*a*, 34*c*, and pin 32*b* is located in the opposite end of slot 34*b*. In the unlocked position, jaw 16 is free to ratchet across the faces of the workpiece when the user rotates wrench 10 in either direction.

The inner, concave sides of plates 20, 22, 28 (i.e., the sides of plates 20, 22, 28 that face each other) are notched to define a series of elongated workpiece contact surfaces 40 which meet at notches 42. Each contact surface 40 is configured to engage a face of the workpiece over a major portion (such as at least 54%) of the length of the face. Contact surfaces 40 are cut to accommodate a six-sided workpiece in either a standard, 0 degree rotated position or a 30 degree rotated position. Adjacent surfaces 40 that meet at a notch 42 are oriented at an angle that matches the angle defined by a pair of adjacent faces of the workpiece (which, for a hexagonal bolt head or nut, is 120 degrees). Jaws 14, 16 can have the same or different numbers of contact surfaces 40.

Jaws 14, 16 are reinforced by members 44, 46, 48, which are notched in the same manner as plates 20, 22, 28. Member 44 is welded within slot 26 between the distal ends of plates 20, 22 at jaw 14. Members 46, 48 are welded to opposite sides of movable plate 28 at jaw 16. In addition to adding strength, members 44, 46, 48 increase the surface contact area of jaws 14, 16 with the workpiece. As a result, jaws 14, 16 contact the workpiece over their full width to enhance the gripping ability of wrench 10.

Figure 5:
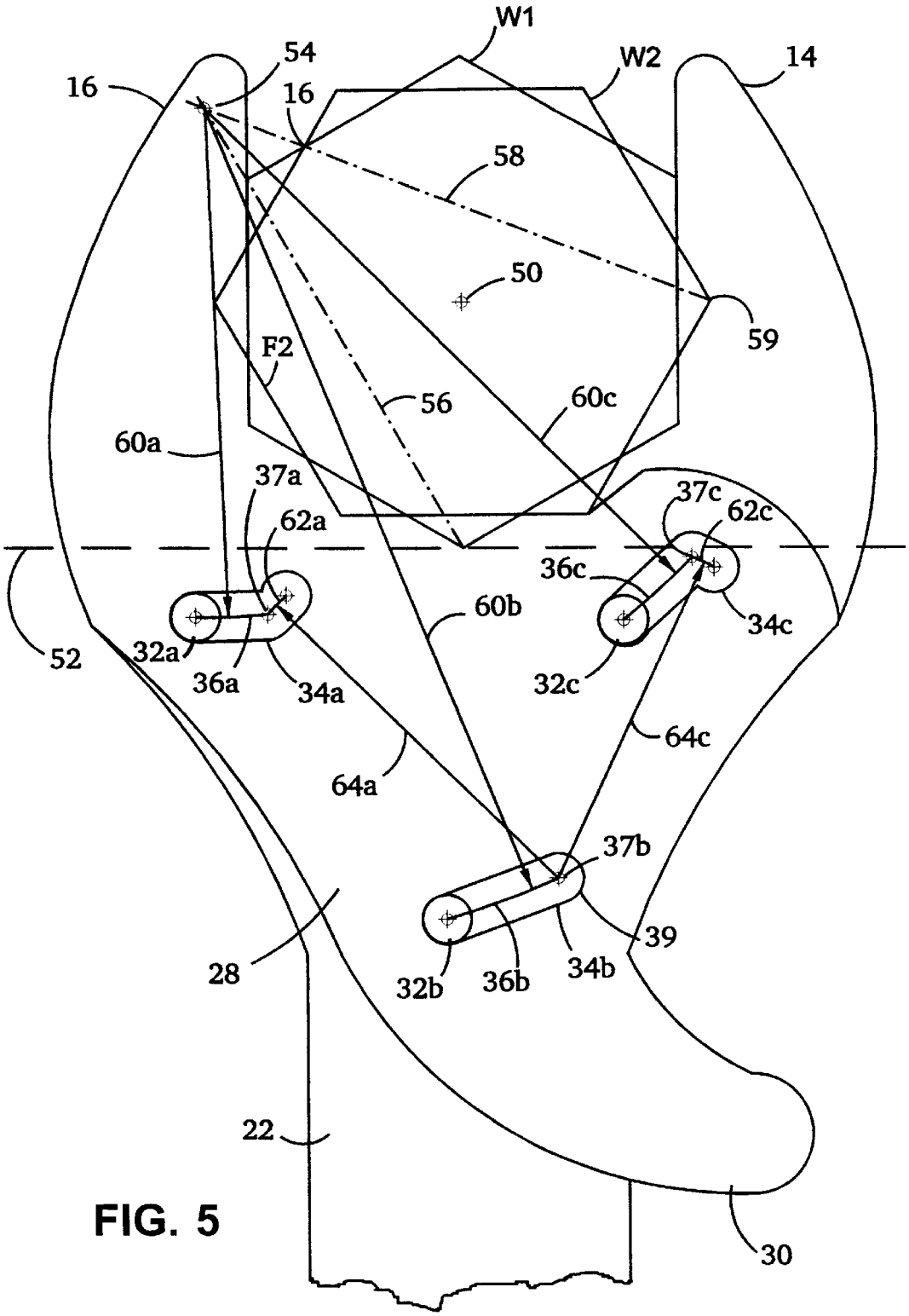
FIG. 5 is useful in understanding the locking, unlocking, and ratcheting operations of the wrench.

Referring to FIG. 5 (which shows wrench 10 with plate 20 removed for ease of explanation), the configuration and location of slots 34*a*–34*c* will be explained. To provide a frame of reference, a workpiece centered about point 50 is shown captured between jaws 14, 16 in a 0 degree (i.e., standard) position W1 and a 30 degree rotated position W2. In both positions, jaw contact surfaces 40 engage four faces of the workpiece. To allow jaw 16 to be alternatively locked and unlocked as described above, slots 34*a*–34*c* should be positioned proximally of the proximal ends of jaws 14, 16. In this embodiment, the major portions of slots 34*a*–34*c* are positioned proximally of line 52, which is drawn perpendicularly to the longitudinal axis of wrench 10 at the proximalmost point of engagement between the workpiece and jaws 14, 16.

The major segments of the lengths of slots 34*a*, 34*c* (i.e., the longer leg of the L-shape), and the entire length of slot 34*b*, are oriented along respective arcs 36*a*–36*c* which have a common center point 54 near the distal end of jaw 16. Point 54 is the center of rotation of movable plate 28 during the unlocking operation, and thus slots 34*a*–34*c* allow plate 28 to slide over pins 32*a*–32*c* during unlocking. Point 54 should be positioned as far distally on (i.e., toward the tip of) jaw 16 as possible, to allow the user to rotate plate 28 (by depressing lever 30) without interference from the corners of the workpiece in either position W1 or W2. At a minimum, point 54 should be located distally of the distalmost contact point between jaw 16 and the workpiece. In addition, to reduce the risk of plate 28 springing open during use, point 54 should be positioned to minimize the angles between arcs 36*a*–36*c* and line 52. (Indeed, arc 36*a* preferably is oriented approximately parallel to line 52.)

I have found that a position for point 54 that meets all of these criteria is conveniently determined by the intersection of a pair of lines 56, 58 drawn from the corners of the workpiece in respective positions W1, W2, as shown. Line 56 extends from the proximalmost corner of workpiece in position W1 approximately parallel to face F2 of the workpiece in position W2. Line 58 extends from corner 59 of workpiece position W2 through an intersection 61 between workpiece faces in positions W1 and W2. In particular, the use of line 56 to locate point 54 helps ensure that plate 28 will be moved smoothly away from the workpiece during the unlocking operation.

Arcs 36*a*–36*c* are respectively positioned at radii 60*a*–60*c* from point 54. Each radius 60*a*–60*c* is sufficiently long to place respective slots 34*a*–34*c* proximally of line 52, while also spacing slots 34*a*–34*c* from the edges of movable plate 28 so as not to weaken plate 28. That is, slots 34*a*, 34*c* are located in a relatively wide regions of plate 28 behind the proximal end of jaws 14, 16. Slot 34*b* is more proximally positioned in the base of wrench head 12 adjacent to lever 30. Arcs 36*a*, 36*c* define the centers of the long segments of L-shaped slots 34*a*, 34*c*, and arc 36*b* defines the center of slot 34*b* along its entire length.

The lengths of arcs 36*a*–36*c* are such that when the user moves plate 28 to the unlocked position with lever 30, the proximal end of jaw 16 is pivoted sufficiently to allow jaw 16 to ratchet across the faces of the workpiece when handle 18 is rotated. (I have found that a range of motion of about 8 degrees is sufficient for this purpose.) In the unlocked position, pin 32*b* is repositioned to end 39 of slot 34*b* such that the center of pin 32*b* is located at point 37*b*, and pins 32*a*–32*c* are located at corners 37*a*, 37*c*, respectively, between the long and short segments of L-shaped slots 34*a*, 34*c*. The shorter segments of L-shaped slots 34*a*, 34*c* are centered along arcs 62*a*, 62*c*, which defined by radii 64*a*, 64*c* extending from point 37*b*. Arcs 62*a*, 62*c* describe the rotation of movable plate 28 around point 37*b* during the ratcheting of wrench 10, as described below.

Figure 6:
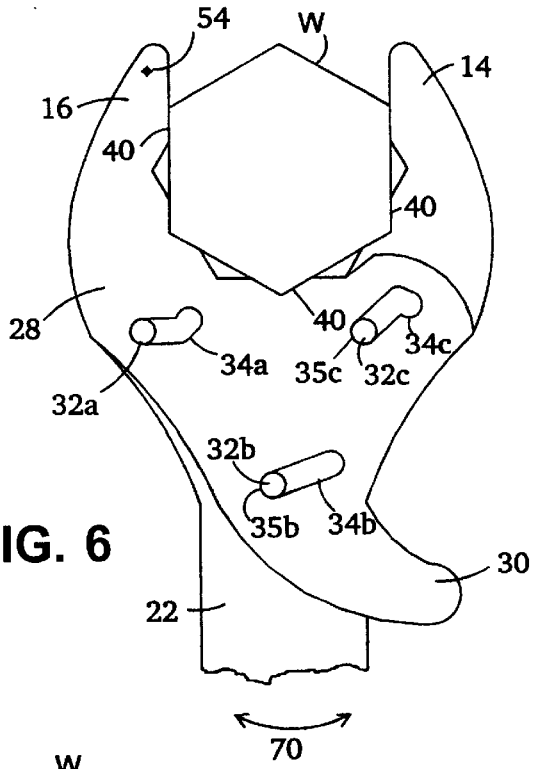
FIGS. 6–8 show the operation of the wrench of FIG. 1 when locked (FIG. 6) and unlocked (FIG. 7), and during ratcheting (FIG. 8).
Figure 7:
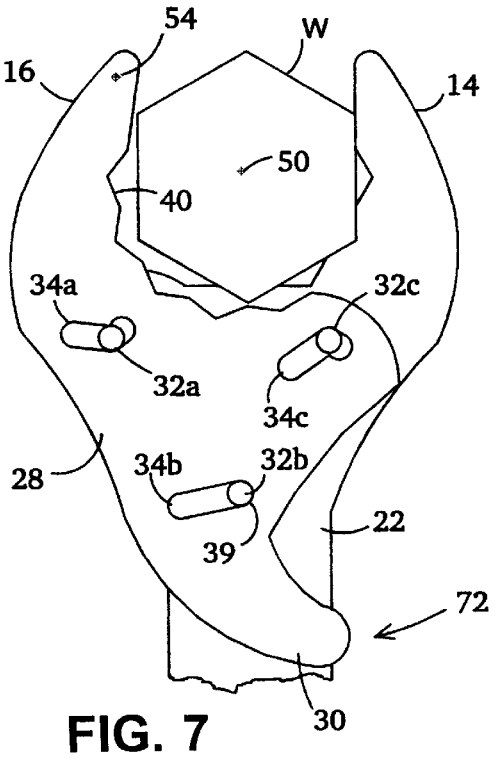
Figure 8:
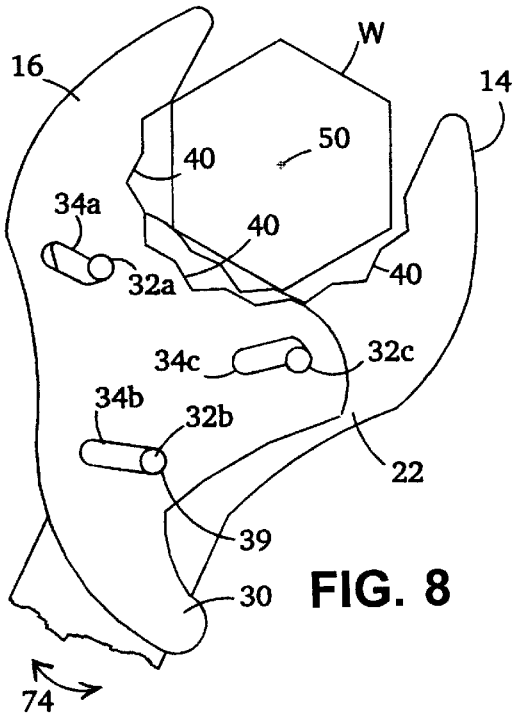

Referring to FIGS. 6–8, the operation of wrench 10 in both the locked and unlocked configurations will be described. When jaws 14, 16 are slid onto workpiece W from the side, the biasing provided by spring 36 (FIG. 3) urges jaw 16 into the locked position, so that contact surfaces 40 engage and grasp the workpiece faces. When the user rotates wrench 10 in either the clockwise or the counterclockwise direction (represented by double-headed arrow 70 in FIG. 6), the resistance provided by workpiece W tends to spread jaw 16 away from jaw 14 at the distal end (rather than the proximal end) of jaw 16. Plate 28 attempts to rotate counterclockwise about pin 32*a* and spread the distal end of jaw 16 away from jaw 14, but this motion is blocked by the orientation of slots 34*a*–34*c* and by the engagement of pins 32*b*, 32*c* against ends 35*b*, 35*c* of slots 34*b*, 34*c*. (The resistance to spreading is proportional to the length of radius 60*b*, and thus increasing radius 60*b* enhances this resistance.) Accordingly, plate 28 (and hence jaw 16) is maintained in a locked, closed position against workpiece W.

Referring to FIGS. 7 and 8, the user performs the unlocking operation by depressing lever 30 (in the direction of arrow 72) against the force of spring 36. This rotates plate 28 around point 54 until pin 32*b* engages end 39 of slot 34*b*, and spreads the proximal end of jaw 16 away from jaw 14. Wrench 10 can now be ratcheted in either direction 74 around workpiece W (FIG. 8 shows ratcheting in the clockwise direction). As the user rotates wrench 10 around workpiece center 50, plate 28 pivots around pin 32*b* and distal end of jaw 16 springs open as jaws 14, 16 pass over the corners of workpiece W. During this ratcheting action, pins 32*a*, 32*c* reciprocate along arcs 62*a*, 62*c* (FIG. 5) within the shorter segments of L-shaped slots 34*a*, 34*c* between the positions shown in FIGS. 7 and 8. Due to the biasing of spring 36 (FIG. 3), the user should hold down lever 30 (e.g., with his thumb) to avoid plate 28 returning to the locked position.

Due to the locking and unlocking action, wrench 10 is completely bidirectional. That is, unlike the wrench described in my U.S. Pat. No. 5,456,143 (which could drive the workpiece in one direction only and must be turned over to rotate the workpiece in the opposite direction), when wrench 10 is locked it can be used to both tighten workpiece W (i.e., rotate the workpiece in a clockwise direction) and loosen workpiece (by rotating it in a counterclockwise direction). In addition, when wrench 10 is unlocked, jaws 14, 16 will ratchet over the workpiece when it is rotated in either direction.

Other embodiments are within the scope of the following claims.

Figure 9:
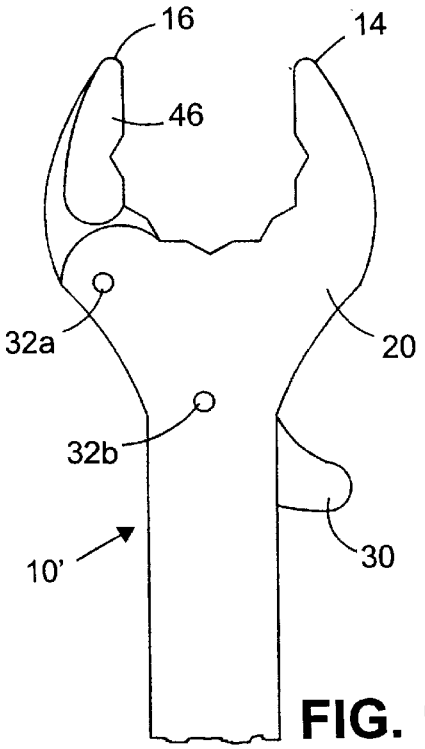
FIGS. 9–14 illustrate alternative embodiments of the wrench of FIG. 1.
Figure 10:
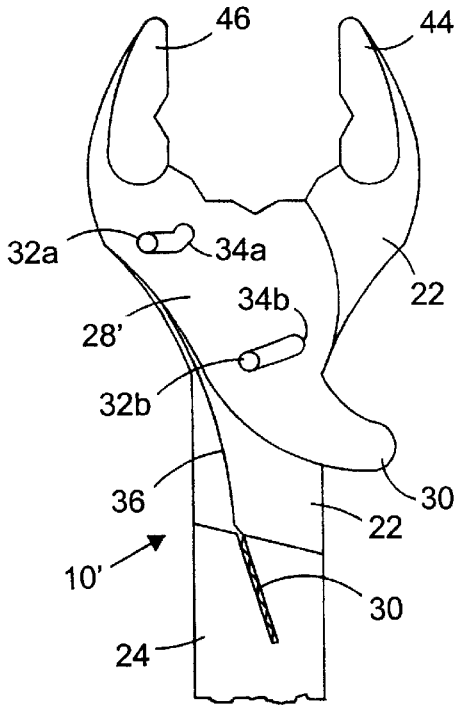

For example, although pin 32*a* (and its corresponding slot 34*a*) must be present, either pin 32*b* or pin 32*c* (but not both pins) can be omitted. Referring to FIGS. 9 and 10 wrench 10' includes pins 32*a*, 32*b* but not pin 32*c*. The omission of pin 32*c* (and slot 34*c*) allows the size of movable plate 28' to be reduced.

Figure 11:
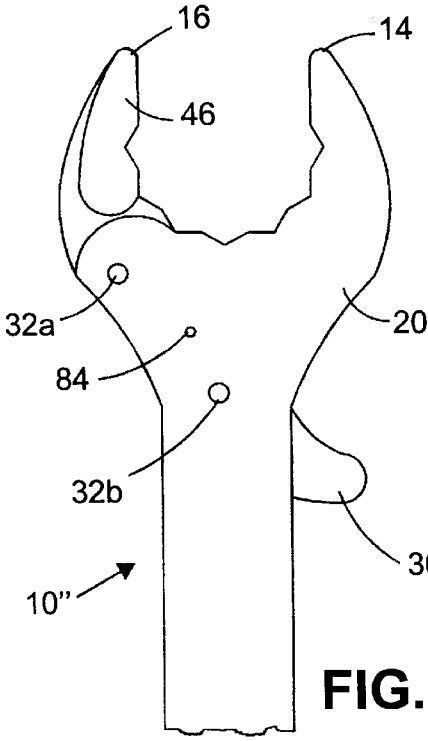
Figure 12:
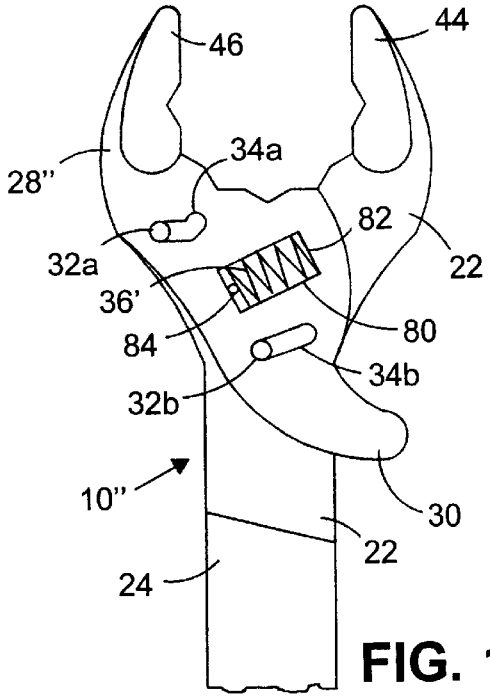

Referring to FIGS. 11 and 12, springs other than a leaf spring may be used to resiliently bias jaw 16. In wrench 10", leaf spring 36 is replaced by a coil spring 36' positioned within a cavity 80 in movable plate 28". Spring 36' is compressed between an end 82 of cavity 80 and a post 84 which is secured to plates 20, 22. Like leaf spring 36 in the embodiments discussed above, spring 36' urges movable plate 28" (and hence jaw 16) into the locked position, and this biasing is overcome by depressing lever 30.

Figure 13:
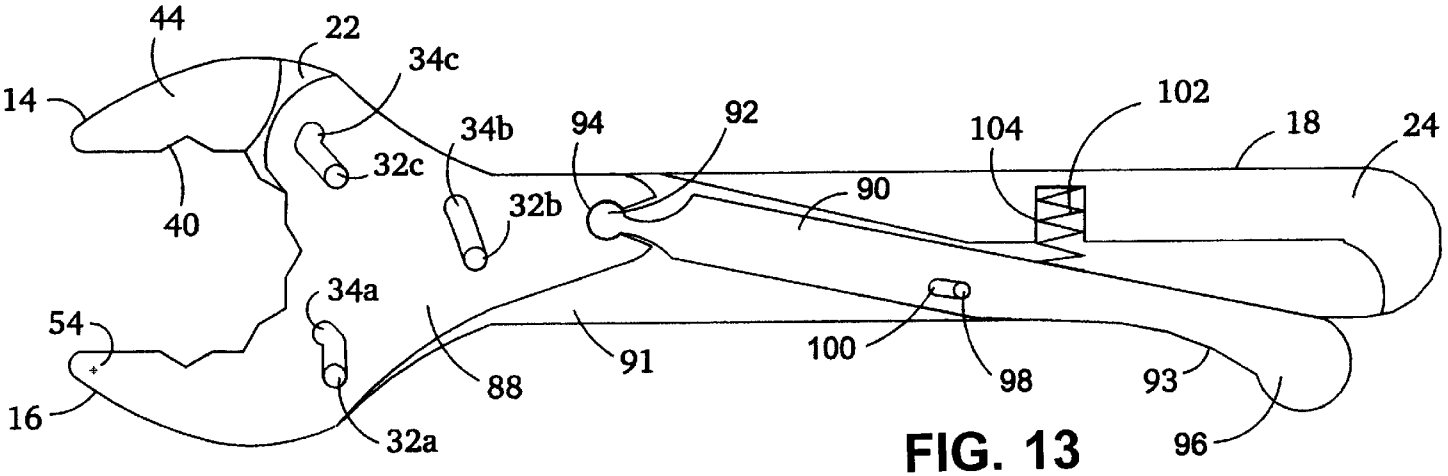
Figure 14:
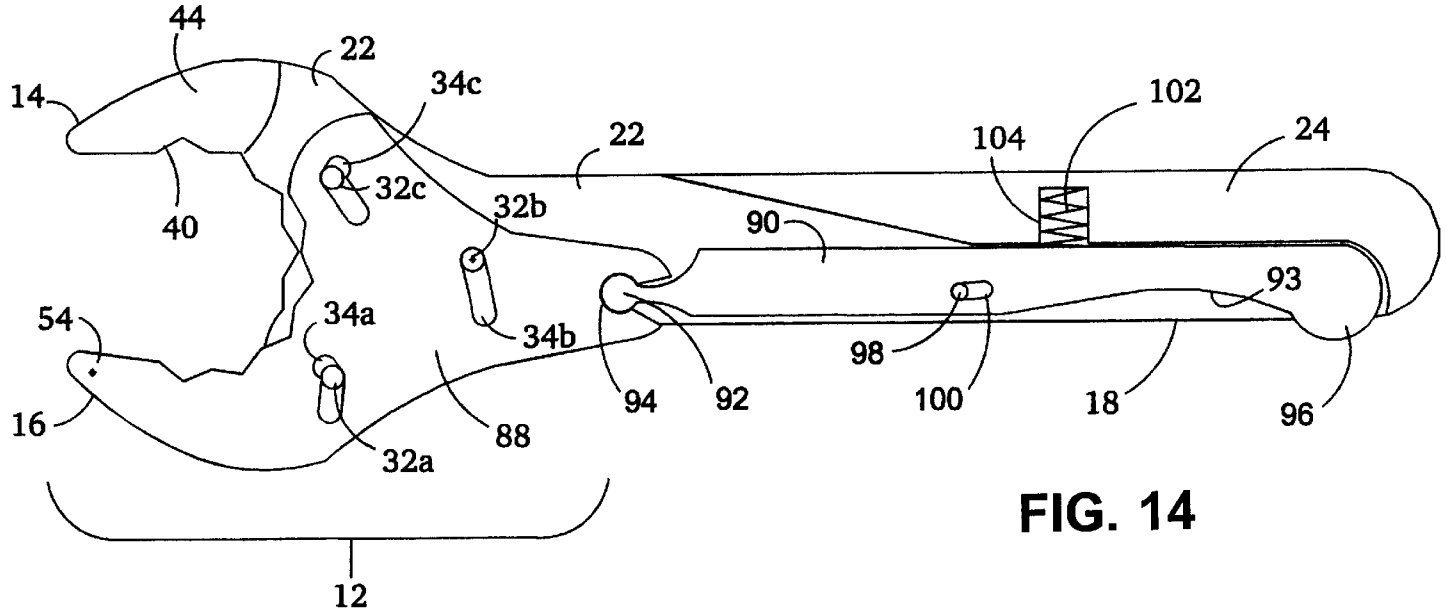

Other ways of locking and unlocking the wrench are possible. For example, referring to FIGS. 13 and 14 (which shows the wrench with outer plate 20 removed), movable plate 88 is connected to a user-actuatable lever 90 by a pivotable joint. A ball 92 on one end of lever 90 fits within a socket 94 in the proximal end of plate 88; the user actuates lever 90 with a knob 96 at the opposite end of lever 90. Lever 90 is pivotally mounted within a channel 91 in handle 18 by the engagement of a pin 98 (secured to plates 20, 22) in an elongated slot 100 in lever 90. A spring 102 mounted in a slot 104 in handle plate 24 engages lever 90 to bias jaw 16 in the locked position (FIG. 13).

The user unlocks jaw 16 simply by squeezing knob 96 against handle 18. Lever 90 pivots about pin 98, thereby rotating plate 88 to unlocked position shown in FIG. 14. The elongation of slot 100 accommodates the axial motion that lever 90 undergoes as it moves to the unlocked position. To avoid accidental unlocking, lever 90 is narrowed 93 near its proximal end so that only knob 96 (which is positioned at the extreme proximal end of the wrench) protrudes from handle 18. Because knob 96 is positioned at the proximal end of handle 18 (rather than immediately behind head 12 as in the wrench of FIG. 1), the wrench head of FIGS. 13 and 14 may fit into relatively tight spaces.

Still other embodiments of an open-end ratchet wrench are within the scope of the following claims.

Figure 15:
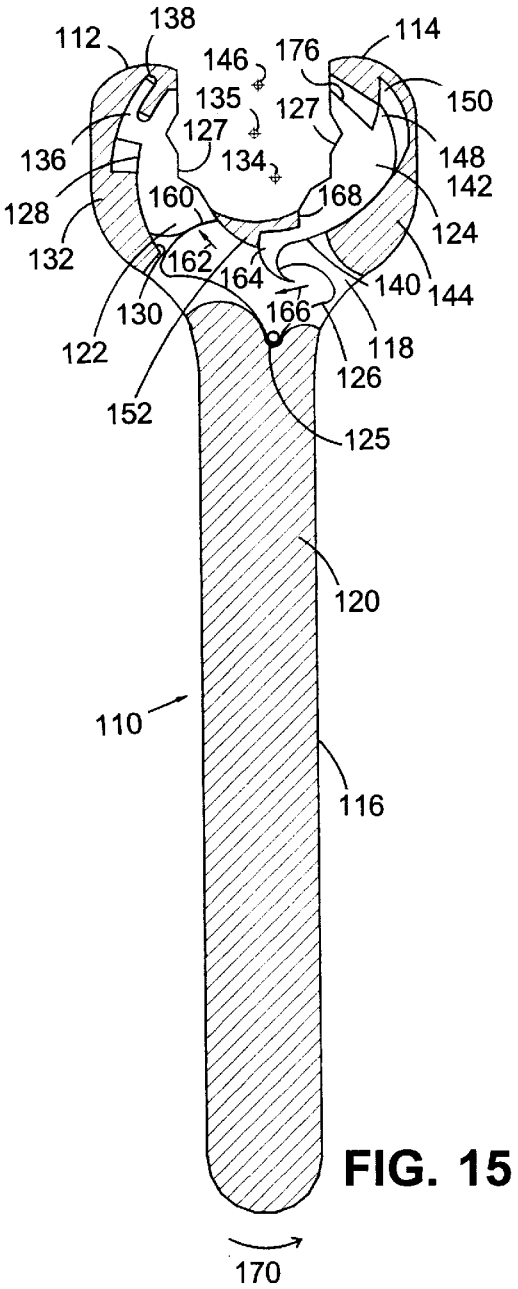
FIGS. 15 and 16 show another open-end ratchet wrench, with the front face plate removed to illustrate a pair of elongated plates which are pivotally mounted within curved cavities in stationary jaws.
Figure 16:
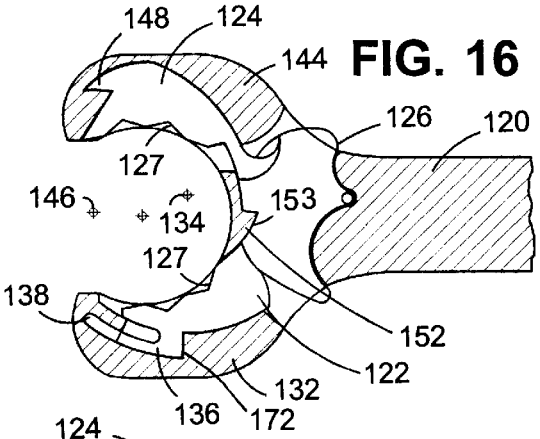

For example, referring to FIGS. 15–16, wrench 110 is similar to the wrenches shown in my U.S. Pat. No. 5,456,143 entitled "Open End Ratchet Wrench," which is incorporated herein by reference. Wrench 110 includes a pair of arcuate jaws 112, 114 at the end of an elongated handle 116. Jaws 112, 114 and handle 116 are defined by a pair of face plates 118 (one of which is not shown in FIGS. 15–16 to allow the ratcheting mechanism to be seen). A central plate 120 is sandwiched between face plates 118 in handle 116 to define cavities in jaws 112, 114 for a pair of pivotally mounted, elongated plates 122, 124 that are biased together by a leaf spring 126 mounted in handle 116. Plates 118, 120 are secured together in handle 116 by a set of screws (not shown).

Elongated plates 122, 124 are curved (more specifically, reniform, or kidney, shaped) and are slightly thinner than central plate 120 so that they may move easily between face plates 118. The inner concave sides of plates 122, 124 are each notched to provide a series of elongated workpiece contact surfaces 127 oriented to engage faces of a hexagonal workpiece. The peripheral surface 128 of plate 122 is curved and engages a complementary curved bearing surface 130 of a stationary bearing plate 132 secured to face plates 118. The curvature of surfaces 128, 132 allows plate 122 to rotate around point 134 (which is offset from center 135 of a workpiece (not shown) positioned between jaws 112, 114). Pivotable plate 122 is secured within jaw 112 by the engagement of a curved projection 136 on plate 122 within a complementary groove 138 in bearing plate 132.

The peripheral surface 140 of pivotable plate 124 is curved and engages a complementary curved bearing surface 142 of a stationary bearing plate 144 on jaw 114. The curvature of surfaces 140, 142 allows plate 124 to rotate about point 146 (also offset from workpiece center 135). A projection 148 on the distal end of plate 124 is configured to slide within a recess 150 of bearing plate 144 during ratcheting. A third bearing plate 152 (separated from spaced bearing plates 132, 144 by portions of the plate cavities) is positioned at the proximal end of jaws 112, 114 to provide a third point of attachment for pivotal plates 122, 124 and help limit their range of motion. Bearing plates 132, 144, 152 are approximately the same thickness as central plate 120 to allow pivotal plates 122, 124 to freely slide within jaws 112, 114.

Leaf spring 126 is secured at approximately its center between the distal end of central plate 120 and a pin 125. One end of leaf spring 126 pushes against a base 160 of plate 122 in the direction of arrow 162 to bias plate 122 distally toward the tip of jaw 112. This motion urges projection 136 into groove 138 and contact surfaces 127 of plate 122 into the workpiece opening. The opposite end of leaf spring 126 engages a hook-like projection 164 on the base of plate 124, and biases plate 124 in the direction of arrow 166 until a shoulder 168 on plate engages third bearing plate 152. This biasing action urges contact surfaces 127 of plate 124 to extend into the workpiece opening.

In operation, by urging pivotal plates 122, 124 in the direction of arrows 162, 166, respectively, leaf spring 126 resiliently urges plates 122, 124 to rotate inwardly (around centers of rotation 134, 146) against the workpiece, thereby causing plates 122, 124 to grasp the workpiece therebetween. When the user rotates wrench handle 116 in the direction of arrow 170 (i.e., counterclockwise in FIG. 15), the curvature of plate peripheral surfaces 128, 140 and bearing plate surfaces 130, 142, the engagement of projection 136 in groove 138, and the engagement of shoulder 168 against third bearing plate 152 prevent plates 122, 124 from moving radially outwardly. As a result, the force exerted by the user is applied through contact surfaces 127 of plates 122, 124 to rotate the workpiece.

Rotating wrench handle 116 in the opposite direction produces ratcheting action, which causes the workpiece to remain stationary as handle 116 is turned. That is, rotation of handle 116 in the opposite direction of arrow 170 applies pressure to the workpiece via contact surfaces that are oriented approximately in-line with curved pivotal plate surfaces 128, 140 and curved bearing plate surfaces 130, 142. The curvature of these surfaces allows pivotal plates 122, 124 to rotate outwardly (around centers of rotation 134, 146) against the biasing of spring 126 to the position shown in FIG. 16, thereby causing plates 122, 124 to slip over the workpiece as handle 116 is turned. Leaf spring 126 is compressed by the motion of plate 122 and is expanded by the motion of pivotal plate 124.

As shown in FIG. 16, bearing plates 132, 144, 152 serve as stops which limit the range of motion of pivotal plates 122, 124 during ratcheting. A shoulder 172 on plate 122 engages a complementary abutment on bearing plate 132. (During the motion of plate 122 against the biasing of spring 126, plate 122 slides along a curved interior surface 153 of bearing plate 152.) As projection 148 on the distal end of plate 124 fully enters recess 150 against the biasing force of spring 126, a curved face 176 of plate 124 engages a complementary surface of bearing plate 144. As a result, during ratcheting, plates 122, 124 repeatedly pivot about points 134, 146 between the positions shown in FIGS. 15, 16 as contact surfaces 127 slide over the workpiece.

Figure 17:
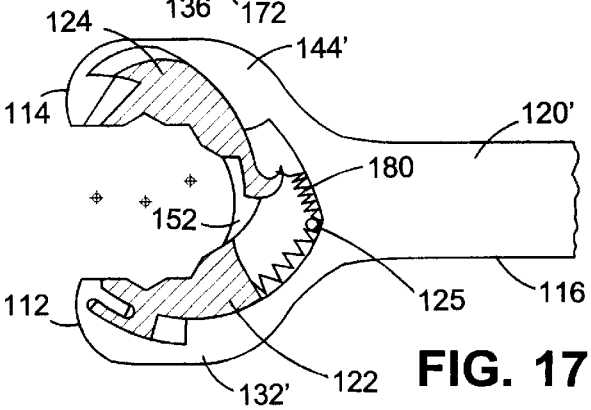
FIGS. 17 and 18 show alternative embodiments of the wrench of FIGS. 15 and 16.
Figure 18:
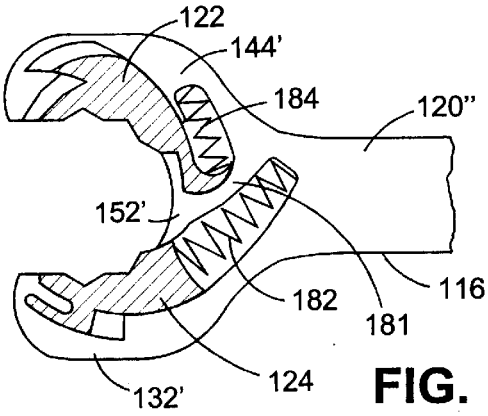

FIGS. 17 and 18 show alternative ways of mounting pivotal plates 122, 124 in the wrench head. In the configuration shown in FIG. 17, bearing plates 132', 144' are integral distal extensions of central plate 124' (i.e., bearing plates 132', 144' are contiguous with each other). In addition, the biasing of plates 122, 124 is provided by a coil spring 180, which extends between pin 125 and the bases of plates 122, 124. As with leaf spring 126, one portion of spring 180 (the portion between pin 125 and plate 124) is in tension, while the other portion (the portion between pin 125 and plate 122) is in compression.

In the wrench head shown in FIG. 18, third bearing plate 152' is also configured as an integral distal extension 181 of central plate 120". That is, bearing plates 132', 144', 152' are all contiguous with each other and with central plate 120'. This construction separates the cavities in which plates 122, 124 are placed, and creates a pair of chambers in which separate coil springs 182, 184 (both of which are in compression) are positioned. Spring 182 biases plate 122 to the driving position (shown in FIG. 18), while plate 124 is biased into the driving position by spring 184. Constructing bearing plates 132', 144' and 152' from one contiguous piece of material with plate 120" both strengthens the wrench and eases manufacture.

Still other embodiments are within the scope of the following claims.

I claim:

1. A wrench comprising a pair of jaws mounted on a handle for engaging a workpiece, a first one of said jaws being mounted for selective actuation between a stationary position with respect to a second one of said jaws so that said jaws engage and rotate the workpiece when said handle is rotated, and a movable position with respect to said second jaw so that said jaws disengage and slide over the workpiece and allow the workpiece to remain stationary when said handle is rotated, an actuator for moving said first jaw between said stationary position and said movable position, and a plate attached to said first jaw, said plate being mounted to said handle by engagement of a plurality of pins on said handle with a corresponding plurality of slots in said plate, and being movable by said actuator to position said pins in selected portions of said slots thereby to move said first jaw between said stationary position and said movable position.

2. The wrench of claim 1 wherein said first jaw is mounted so that when said first jaw is in said stationary position said jaws grip and rotate the workpiece when said handle is rotated in either of two directions with respect to the workpiece.

3. The wrench of claim 2 wherein said first jaw is mounted so that when said first jaw is in said movable position said jaws slide over the workpiece when said handle is rotated in either of two directions with respect to the workpiece.

4. The wrench of claim 3 further comprising a spring coupled between said handle and said first jaw to bias said first jaw to said stationary position.

5. The wrench of claim 1 wherein said slots are configured so that said engagement resists pivotal movement of said plate when said pins are positioned at ends of said slots, and said engagement allows pivotal movement of said plate when said actuator positions said pins in regions of said slots spaced from said ends.

6. The wrench of claim 5 further comprising a spring coupled between said handle and said plate to bias said plate so that said pins are positioned at said ends of said slots, thereby to bias said first jaw into said stationary position, said actuator being coupled to move said plate against the bias of said spring to position said pins in said spaced regions of said slots, thereby to move said jaw to said movable position.

7. The wrench of claim 1 wherein said slots are disposed between said actuator and said first jaw.

8. The wrench of claim 1 wherein said actuator is rigidly mounted to said plate.

9. The wrench of claim 1 further comprising a pivotal joint connecting said actuator to said plate.

10. The wrench of claim 5 wherein said spaced regions of said slots are arranged around a center of rotation located in a distal region of said first jaw to allow said first jaw to rotate about said center of rotation and disengage a proximal region of said first jaw from the workpiece when said actuator positions said pins in said spaced regions.

11. The wrench of claim 10 wherein a first one of said slots further comprises a segment arranged around a center of rotation located at a second end of a second one of said slots so that when said actuator positions a second one of said pins at said second end and said handle is rotated, said first jaw pivots about said second pin and said first pin travels in said segment, thereby allowing said jaws to slide over the workpiece.

12. The wrench of claim 11 wherein said second slot is disposed proximally of said first slot.

13. The wrench of claim 11 wherein a third one of said slots comprises a said spaced region arranged around said center of rotation located in a distal region of said first jaw and a segment arranged around said center of rotation located at said second end of said second slot, a third one of said pins traveling in said third slot segment during said pivoting of said first jaw.

14. The wrench of claim 1 wherein a second one of said jaws is rigidly mounted to said handle.

15. The wrench of claim 1 wherein each one of said jaws includes at least one notch that defines a plurality of surfaces each of which is arranged to engage a face of said workpiece.

16. The wrench of claim 15 further comprising reinforcing members secured to said jaws.

17. The wrench of claim 1 wherein said first jaw extends from a proximal region adjacent to said handle to a distal end, said actuator forming a proximal extension of said proximal region.

18. The wrench of claim 17 wherein said proximal extension formed by said actuator is unitary with said proximal region of said first jaw.

19. A wrench comprising a pair of jaws disposed on a handle, a first one of said jaws being attached to a plate that is mounted to said handle by engagement of a plurality of pins on said handle with a corresponding plurality of slots in said plate, a second one of said jaws being rigidly mounted to said handle, said slots being configured so that said engagement resists pivotal movement of said plate when said pins are positioned at ends of said slots, and said engagement allows pivotal movement of said plate when said pins are positioned in regions of said slots spaced from said ends, an actuator coupled to move said plate between a first position in which said pins are positioned at ends of said slots to cause said first jaw to be stationary with respect to said second jaw so that said jaws engage and rotate the workpiece when said handle is rotated, and a second position in which said pins are positioned in said spaced regions of said slots to cause said first jaw to be movable with respect to said second jaw so that said jaws disengage and slide over the workpiece and allow the workpiece to remain stationary when said handle is rotated, and a spring coupled between said handle and said actuator to bias said plate into said first position.

* * * * *